US005571987A

United States Patent [19]

Goto et al.

[11] Patent Number: 5,571,987

[45] Date of Patent: Nov. 5, 1996

[54] DEVELOPING APPARATUS USING MAGNETIC DEVELOPING POLES HAVING THE SAME POLARITY

[75] Inventors: Ryuji Goto, Fukaya; Koji Noguchi, Saitama-ken, both of Japan

[73] Assignee: Hitachi Metals, Ltd., Tokyo, Japan

[21] Appl. No.: 598,624

[22] Filed: Feb. 12, 1996

Related U.S. Application Data

[63] Continuation of Ser. No. 188,130, Jan. 28, 1994, abandoned, which is a continuation of Ser. No. 948,449, Sep. 22, 1992, abandoned.

[30] Foreign Application Priority Data

Oct. 4, 1991 [JP] Japan ..... 3-257389

[51] Int. Cl.[6] ..... G03G 15/09

[52] U.S. Cl. ..... 399/276

[58] Field of Search ..... 355/251, 253; 118/656, 658; 430/122

[56] References Cited

U.S. PATENT DOCUMENTS

| | | | |
|---|---|---|---|
| 4,030,447 | 6/1977 | Takahashi et al. | 118/658 |
| 4,168,901 | 9/1979 | Ito et al. | 355/251 X |
| 4,331,100 | 8/1982 | Mochizuki et al. | 118/657 |
| 4,498,755 | 2/1985 | Ohkubo et al. | 118/658 X |
| 4,499,169 | 2/1985 | Haneda et al. | 430/102 |
| 4,557,992 | 12/1985 | Haneda et al. | 118/658 X |
| 4,640,880 | 2/1987 | Kawanishi et al. | 430/106.6 |
| 4,780,741 | 10/1988 | Wada et al. | 355/253 |
| 4,833,505 | 5/1989 | Furuya et al. | 355/251 X |
| 4,901,116 | 2/1990 | Haneda et al. | 355/253 |
| 5,053,305 | 10/1991 | Aoki et al. | 430/111 |

FOREIGN PATENT DOCUMENTS 62-55149 1/1978 Japan .

*Primary Examiner*—Robert Beatty

*Attorney, Agent, or Firm*—Finnegan, Henderson, Farrabow, Garrett & Dunner

[57] ABSTRACT

A developing apparatus including a fixed permanent magnet member 4 having a plurality of magnetic poles on the surface and a non-magnetic cylindrical sleeve 5 which is rotated around the permanent magnet member 4 at a position opposing a movable image-bearing member 1 having an electrostatic latent image on the surface, to form a developing region Z; causing a developer 3 to be magnetically attracted onto a surface of the non-magnetic cylindrical sleeve 4, and rotating the non-magnetic cylindrical sleeve 4 to convey the developer 3 into the developing region Z, and developing the electrostatic latent image with the magnetic toner 3, the moving velocity of the developer 3 in the developing region Z being higher than the peripheral velocity of the non-magnetic cylindrical sleeve 5.

3 Claims, 1 Drawing Sheet

DEVELOPING APPARATUS USING MAGNETIC DEVELOPING POLES HAVING THE SAME POLARITY

This application is a continuation of application Ser. No. 08/188,130 filed Jan. 28, 1994, which is a continuation of application Ser. No. 07/948,449 filed Sep. 22, 1992, both now abandoned.

BACKGROUND OF THE INVENTION

The present invention relates to a developing method for visualizing an electrostatic latent image formed on an image-bearing member surface with a magnetic developer including a magnetic toner and magnetic carrier in an electrophotographic method, an electrostatic recording method, and an electrostatic printing method, etc.

Conventionally, in a typical electrophotographic method, an electrostatic latent image formed on a photosensitive material surface is visualized with colored resin particles called toners, and the resulting toner image is fixed to a transfer sheet such as a plain paper by heating or pressurizing means to obtain a fixed image. Various methods of developing such an electrostatic latent image have been proposed so far. Among them, there is a method in which magnetic toner consisting of toner particles comprising a binder resin and magnetic powder is supplied onto a non-magnetic sleeve, to form a magnetic brush on the sleeve by a relative rotation of the sleeve and a permanent magnet member disposed inside the sleeve, and an image-bearing member surface is in slidable contact with this magnetic brush, thereby permitting the toner particles to attach to the electrostatic latent image.

In this one-component magnetic toner system, a chargeable magnetic toner, which contains a charge-controlling agent so that the toner may be strongly charged in a particular (positive or negative) polarity, is used, and the development of an electrostatic latent image is carried out by utilizing a triboelectric charging phenomenon due to the contact of the toner particles with a sleeve or a doctor blade member. However, when the chargeable magnetic toner is used alone, the toner particles are likely to be agglomerated by electric charging, so that streaks are formed on the image due to a shortage of toner on the sleeve. To obviate this problem, it has been proposed to use a developer comprising magnetic toner and magnetic carrier (for instance, U.S. Pat. Nos. 4,640,880 and 5,053,305).

In such a method of developing an electrostatic latent image by using a developer comprising a chargeable magnetic toner and a magnetic carrier, it is typical that a magnetic carrier having a relatively high conductivity is used, and that the toner concentration is not particularly controlled. Accordingly, the toner concentration is in a wide range of 10–90% by weight in a developing region which is formed between the image-bearing member and the sleeve. When a permanent magnet material is fixed and a sleeve is rotated around it, an image quality is greatly affected by the toner concentration. Therefore, in this case, the toner concentration should be restricted to 30 weight % or less by utilizing toner-controlling means.

Also, since the magnetic toner has an insulating property from the viewpoint of transferability, the electric resistance of the entire developer becomes extremely high as the toner concentration increases. Thus, in order to obtain an image having a high image density and a good quality by using such a developer, efficient development of an electrostatic latent image is required. For this purpose, at least one of the non-magnetic sleeve and the permanent magnet member is usually rotated at a high speed to increase a speed of conveying the developer, thereby improving the development efficiency.

However, when either one of the above members is rotated at a high speed, the developer is likely to be severely damaged which can shorten its life, and large noises tend to be generated in the driving system. There also is a problem that in a case where foreign particles such as paper powder, etc., are accumulated at a doctor blade member, streaks are formed on the image due to a shortage of toner on the sleeve, thereby decreasing the image quality.

OBJECT AND SUMMARY OF THE INVENTION

Accordingly, an object of the present invention is to provide a developing method which has resolved the above problems to improve the development efficiency, thereby producing a higher-quality image, and wherein a life of a developer is longer and a toner concentration scarcely affects the quality of the resulting image.

To achieve the above object, the present invention provides a developing method comprising: providing a developing means comprising a fixed permanent magnet member having a plurality of magnetic poles on the surface and a non-magnetic cylindrical sleeve which is rotated around the permanent magnet member at a position opposing a movable image-bearing member having an electrostatic latent image on the surface, thereby forming a developing region; causing a developer to be magnetically attracted onto the surface of the non-magnetic cylindrical sleeve the developer comprising magnetic toner comprising a binder resin and magnetic powder and capable of being charged at a particular polarity and a magnetic carrier having a relatively large conductivity; and rotating the non-magnetic cylindrical sleeve to convey the developer into the developing region, thereby developing the electrostatic latent image with the magnetic toner, the moving velocity of the developer in the developing region being higher than the peripheral velocity of the non-magnetic cylindrical sleeve.

In the present invention, the permanent magnet member produces a magnetic flux density distribution having a plurality of peaks having the same polarity on the surface of the non-magnetic cylindrical sleeve in the developing region, and the developer moves between the peaks in the same direction as the non-magnetic cylindrical sleeve is rotated.

Due to the above-described construction, the developer moves in the developing region at a higher velocity than the peripheral velocity of the non-magnetic cylindrical sleeve, namely the velocity at which the developer is conveyed into the developing region, thereby improving the development efficiency. Also owing to the above construction, a change in the toner concentration scarcely affects the image quality. Therefore, even in the case where foreign particles such as paper powder, etc., are accumulated at a doctor blade member, the above-described rapid movement of the developer makes it possible to form a normal magnetic brush by making up for the shortage of the developer which may have appeared in the vicinity of the doctor blade member, so that undesirable phenomena such as streaks do not appear on the developed image.

DETAILED DESCRIPTION OF THE INVENTION

The present invention will be explained in detail referring to an embodiment thereof and the drawings attached hereto.

Figure 1:
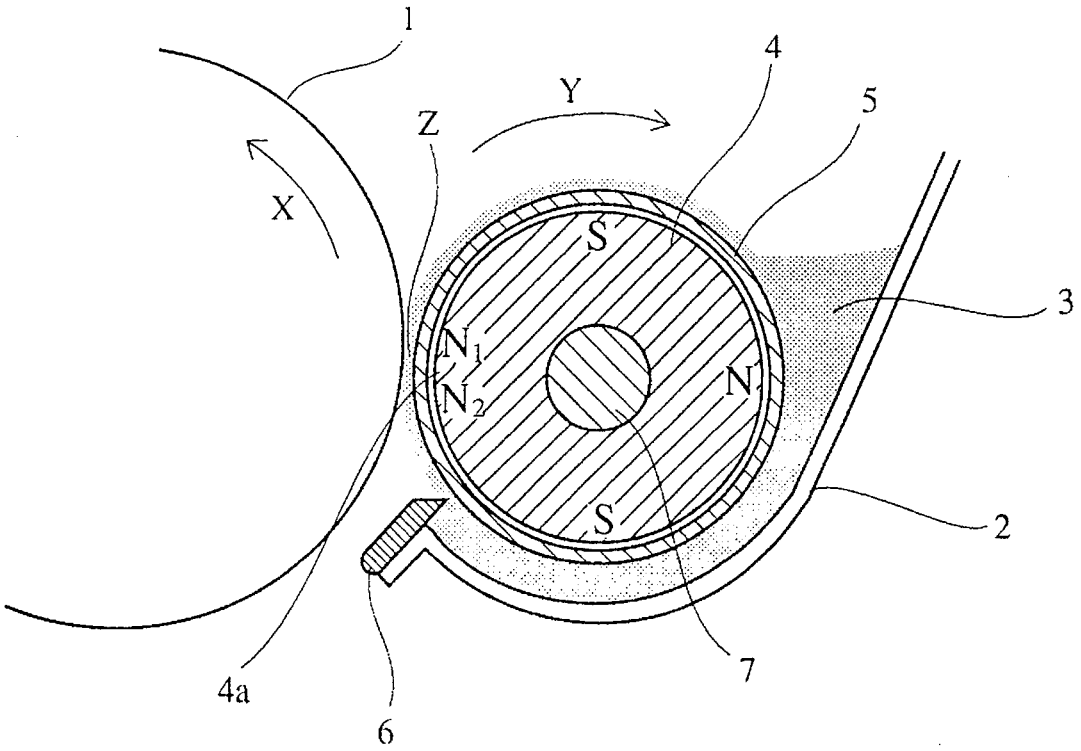
FIG. 1 is a schematic cross-sectional view showing a typical example of a developing apparatus usable for carrying out the developing method of the present invention.

FIG. 1 shows a typical example of a developing apparatus used in the present invention. In FIG. 1, 1 denotes a cylindrical photosensitive member which is rotated in a direction shown by the arrow X. 2 denotes a developer container which holds a developer 3 consisting of a mixture of a magnetic toner and magnetic carrier. 4 denotes a cylindrical permanent magnet member having, on the surface, a plurality of magnetic poles which extend parallel to a shaft 7. The permanent magnet member 4 is positioned so that a developing magnetic pole 4*a* is opposed to the photosensitive member 1. The developing magnetic pole 4*a* is constituted by two magnetic poles of the same polarity $N_1$, $N_2$ disposed with a small interval. 5 denotes a cylindrical sleeve which, for instance, may be formed from a non-magnetic material such as a stainless steel and rotated around the permanent magnet member 4 in a direction shown by the arrow Y. 6 denotes a doctor blade member fixed to the developer container 2 so that its tip faces the sleeve 5. Z denotes a developing region formed between the photosensitive member 1 and the sleeve 5.

Figure 2:
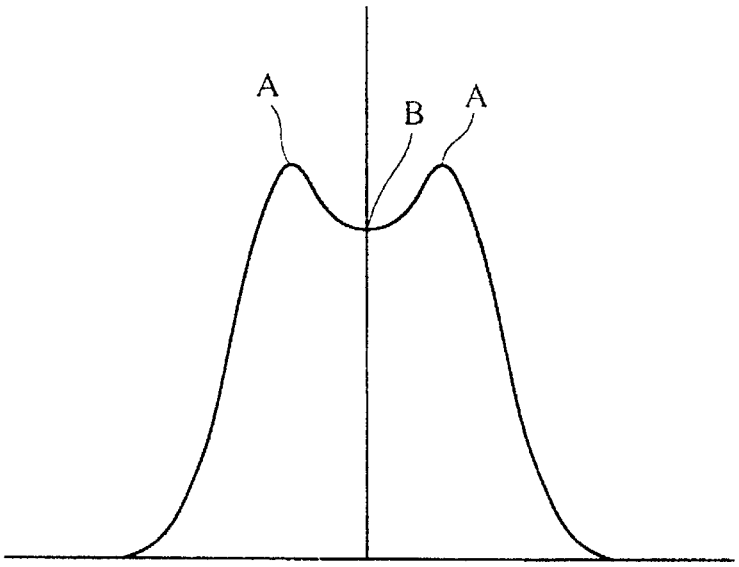
FIG. 2 is a graph showing a distribution of the magnetic flux density on the non-magnetic cylindrical sleeve surface in the developing region of the apparatus shown in FIG. 1.

FIG. 2 is a graph showing a distribution of the magnetic flux density on the surface of the sleeve 5 in the developing region of the apparatus shown in FIG. 1. As shown in FIG. 2, the above distribution has two peaks A, A in the developing region Z. The two peaks A, A can be obtained by making a recess (not shown) on a surface of the permanent magnet member 4 at the developing pole as disclosed in Japanese Patent Publication No. 62-55149.

In the apparatus having the above construction, the photosensitive member 1 and the sleeve 5 are rotated in the directions respectively shown by the arrow X and arrow Y, namely the photosensitive material surface and the sleeve surface move in the same direction in the developing region Z. The developer 3 attracted onto the sleeve 5 due to the magnetic force of the permanent magnet member 4 is conveyed into the developing region Z to form a magnetic brush which is in sliding contact with the surface of the photosensitive member 1 and visualizes the electrostatic latent image thereon. In this case, since there are two peaks A, A in the magnetic flux density distribution on the surface of the sleeve 5 in the developing region as is shown in FIG. 2, the developer 3 moves very quickly between the two peaks. In other words, the velocity of the developer 3 becomes higher than the peripheral velocity of the sleeve 5 (i.e. the velocity at which the developer 3 is conveyed into the developing region) when the developer moves between the two peaks, and thus the development efficiency is improved correspondingly.

With respect to the peripheral velocity $V_s$ of the sleeve 5, it is preferably not lower than the peripheral velocity $V_p$ of the photosensitive member 1, because this peripheral velocity $V_s$ makes the developer 3 move in the developing region faster than the electrostatic latent image (which is developed by a magnetic toner contained in the developer 3). When $V_s$ is extremely high, the magnetic toner is likely to be scattered and severely damaged. Thus, it is preferable that $V_s$ is four times as high as $V_p$ or lower, namely $V_s/V_p$ is between 1 and 4.

The image quality also changes depending upon the strength of the developing magnetic poles ($N_1$ and $N_2$ shown in FIG. 1). In the present invention, these developing magnetic poles respectively have a magnetic flux density of 700–1200G (on the surface of the sleeve 5, and the same will apply hereinafter). When the developing magnetic poles have a magnetic flux density of less than 700G, the magnetic carrier and the magnetic toner are easily scattered from the sleeve 5, so that it is likely that the magnetic carrier is attached to the surface of the photosensitive member 1, and that fogging is generated. This also leads to the deterioration of the image quality, particularly resolution. On the other hand, when the magnetic poles have a magnetic flux density larger than 1200G, the magnetic toner is too strongly attracted to the sleeve 5, resulting in the decrease in the image density.

In the present invention, in addition to the above development conditions, the developer is constituted as follows to obtain a high-quality image.

The magnetic carrier usable in the present invention is produced from iron powder, iron oxide (for instance, magnetite), soft ferrite (for instance, Ni—Zn ferrite, Mn—Zn ferrite, Cu—Zn ferrite), etc. Among these materials, the ferrite carrier is particularly suitable because it is chemically stable, suffers from little change of electric resistivity and has a smaller apparent density.

By evaluating the properties of the magnetic carrier, it has been found that not only its electric and magnetic properties but also its particle size largely affect the image quality. In the present invention, it is possible to use a magnetic carrier having relatively large particle size, namely one having a particle size distribution of 74–149 μm, while in case that high resolution is required, a magnetic carrier having a smaller particle size is used. However, in this case, the magnetic carrier of course should have a particle size larger than that of the toner. Specifically, it is desirable that most of the magnetic carrier is within the range of 20–105 μm, only less than 5% by weight of which is outside the above range. When the carrier particles smaller than 20 μm are 5% or more, the magnetic carrier is likely to attach to the surface of the image-bearing member. On the other hand, when those exceeding 105 μm are 5% or more, the resolution of the resulting image becomes poor. The preferred particle size distribution of the magnetic carrier is within 37–74 μm. Incidentally, an average particle size of the magnetic carrier according to the present invention is desirably 50–70 μm.

With respect to the other properties, a saturation magnetization ($\sigma_s$) and an electric resistivity are important. In the present invention, the saturation magnetization of the magnetic carrier is desirably 30–80 emu/g. When it is smaller than 30 emu/g, the magnetic carrier is likely to attach to the surface of the photosensitive material, and when it exceeds 80 emu/g, the developability becomes poor. The more preferred saturation magnetization of the magnetic carrier is 55–75 emu/g. The electric resistivity of the magnetic carrier is preferably $10^5$–$10^{10}$ Ω.cm (measured in a DC electric field of 200 V/cm). When it is too high, an excess electric charge (which has the same polarity with toner) is likely to be stored in the magnetic carrier, resulting in poor development. On the other hand, when it is too low, breakdown easily takes place even at a low voltage. The more preferred electric resistivity of the magnetic carrier is $10^7$–$10^9$ Ω.cm.

With respect to the magnetic toner, toner particles essentially comprising a binder resin and magnetic powder are usable in the present invention. The binder resin is selected depending upon the fixing method. For instance, in the case of a heat-fixing method, styrene resins, polyester resins, epoxy resins or these mixtures are preferable.

The magnetic powder may be ferromagnetic metals such as iron, cobalt, nickel, etc. or their alloys or compounds containing these elements such as magnetite and ferrite. From the aspect of color and magnetic properties, magnetite is suitable. The amount of the magnetic powder should be 60 weight % or less. When the amount of the magnetic powder is too large, the toner cannot keep its electric charge or is more attracted onto the sleeve, so that it becomes diffcult for the magnetic toner to have a chargeability in a particular polarity. On the other hand, when the amount of the magntic powder is too small, the magnetic toner is likely to be scattered. Accordingly, the lower limit of the magnetic powder is 20%.

In the present invention, in addition to the above indispensable components, the magnetic toner desirably contains a charge-controlling agent such as nigrosine die or azo die containing metal, etc. for attaining a large chargeability in a particular polarity. Further, fluidity improvers (such as silica, alumina, etc.) and resistance-adjusting agents (such as carbon black, etc.) may be added.

The magnetic toner of the present invention can be prepared by known methods such as a pulverization method, a spray-drying method, or a polymerization method. The preferred properties of the magnetic toner used in the present invention are as follows. The particle size distribution is within the range of 5–20 μm, preferably 6–16 μm. Incidentally, when there are a lot of toner particles having a particle size of 8 μm or less, the fogging tends to be generated. Accordingly, toner particles having a particle size of 8 μm or less are preferably 20 weight % or less based on the total weight of the magnetic toner. The specific resistivity of the magnetic toner is $10^{14}$ Ω.cm or more (measured in a DC electric field of 4 kV/cm) from the aspect of transferability.

The developer of the present invention is prepared from the above magnetic carrier and magnetic toner. The amount of the magnetic toner in the developer (toner concentration) may be as wide as 10–90% by weight. The preferred toner concentration is 20–60%. The amount of the magnetic carrier may vary depending upon the materials of the carrier and the size of the developing apparatus. In the case of the ferrite carrier, its amount is preferably 0.05–1 g/cm$^2$ per a unit area of the sleeve.

Apart from the above conditions, the desired development conditions for carrying out the present invention are as follows: With respect to the surface potential of the photosensitive materials, it may vary depending upon the types of the photosensitive material used, and in the case that an organic photosensitive material is used, its surface potential is preferably 400–700 V in an absolute value. Also, in the case of the reverse development of the electrostatic latent image on the organic photosensitive material, a bias voltage 0.6–0.9 times as large as the surface potential in the same polarity is applied to the sleeve to obtain a high-density image with little fogging. With a development gap of 0.2–0.6 mm, good contact between the magnetic brush and the photosensitive material can be obtained. The doctor gap may be the same or slightly smaller than the developing gap.

Incidentally, in the present invention, the magnetic properties of the magnetic carrier and the magnetic toner are measured in a magnetic field (maximum: 10 kOe) by a vibrating sample magnetometer (Model VSM-3, manufactured by Toei Industry Co., Ltd.).

EXAMPLES 1, 2

48 parts by weight of a styrene-n-butyl methacrylate copolymer (Mw: about 200,000, Mn: about 10,000), 50 parts by weight of magnetite (EPT-500, manufactured by Toda Kogyo Corporation) and 2 parts by weight of a Cr-containing azo die (BONTRON E81 manufactured by Orient Chemical Industries, Ltd.) were dry-mixed and heat-blended at 200° C. After cooling and solidifying, the resulting blend was pulverized and added by 0.5 parts by weight of a hydrophobic silica (R972 manufactured by Nippon Aerosil). Then it was submitted to a heat treatment at 120° C. and classified to obtain magnetic toner having an average particle size of 10 μm and an electric resistivity of $5\times10^{14}$ Ω.cm (measured in a DC electric field of 4 kV/cm). This magnetic toner was mixed with ferrite carrier (KBN-100 manufactured by Hitachi Metals, Ltd.) having a particle size of 37–74 μm and an electric resistivity of $10^8$ Ω.cm (measured in a DC electric field of 200 V/cm) to prepare two kinds of developer having a toner concentration of 30% and 50%, respectively.

With each of the above developers, an image was produced by utilizing the apparatus shown in FIG. 1 under the following conditions. In FIG. 1, the photosensitive member 1 was an OPC having a surface potential of −600 V and being rotated at a peripheral speed of 168 mm/sec, and a bias voltage of −490 V was applied to the sleeve 5 to conduct the reverse development. The permanent magnet member 4 had four magnetic poles as shown in FIG. 1. The sleeve 5 was formed from a SUS 304 cylinder having an outer diameter of 32 mm, and rotated at a peripheral speed of 350 mm/sec at which the developer 3 was conveyed into the developing region Z. The developing gap in the developing region Z and the doctor gap between the sleeve 5 and the doctor blade member 6 were 0.40 mm and 0.32 mm, respectively. The surface magnetic flux density at each of the peaks A, A in the FIG. 2 was 1000G, and one at the point B was 800G (Example 1).

With respect to copies produced under the above developing operations, their image densities and fogging were measured. The results are shown in Table 1.

Next, copies were produced in the same manner except that the developer 3 was mixed with paper powder which was finally accumulated at the doctor blade, to observe whether there were white streaks on the copies or not (Example 2). The results are also shown in Table 1.

COMPARATIVE EXAMPLES 1, 2

Copies were produced in the same manner as in Example 1 except that the developing magnetic pole *4a* had a single peak (1000G) in the distribution of magnetic flux density (Comparative Example 1). Their image densities and fogging were measured. The results are shown in Table 1.

Also, copies were produced in the same manner except that the developer 3 was mixed with paper powder which was finally accumulated at the doctor blade, to observe whether there were white streaks on the copies or not (Comparative Example 2). The results are also shown in Table 1.

TABLE 1

| | Toner Concentration (Weight %) | Image Density | Fogging(1) | Streaks(2) |
|---|---|---|---|---|
| Example 1 | 30 | 1.42 | ○ | ○ |
| Example 2 | 50 | 1.42 | ○ | ○ |
| Comparative | 30 | 1.38 | Δ | X |

TABLE 1-continued

| | Toner Concentration (Weight %) | Image Density | Fogging(1) | Streaks(2) |
|---|---|---|---|---|
| Example 1 Comparative | 50 | 1.35 | X | X |

Note 1:
o: Little fogging was generated.
Δ: Some fogging was generated.
X: Much fogging was generated.
Note 2:
o: No white streaks were formed.
X: White streaks were formed.

As is clear from Table 1, images produced by a conventional method in Comparative Examples 1, 2 have low image density with much fogging, because the developing magnetic pole has only one peak in the distribution of magnetic flux density. Further, as the toner concentration becomes higher, the image quality becomes lower. When the toner concentration was 50%, the resolution of the resulting image was poor and there were some images that were too thick to be clear. On the other hand, the images according to the present invention (those produced in Examples 1, 2) have high image density with little fogging, because the developer 3 moves in the developing region at a speed higher than the peripheral speed of the sleeve 5 (namely 350 mm/sec), for instance, at a speed of 500 mm/sec or higher, due to the two peaks shown in FIG. 1. Also, according to the present invention, the toner concentration scarcely affects the resolution of the resulting image, thereby improving the image quality.

With respect to the images which were produced with the developer containing a foreign matter, streaks were formed on the images in Comparative Examples 1, 2. On the other hand, no streaks were formed on the images in Examples 1, 2. Thus it is assumed that even when a gap between the doctor blade member and the sleeve is clogged by a foreign matter such as paper powder, etc., causing a shortage of developer in the vicinity of the doctor blade member, the shortage is made up by rapid supply of the developer 3 due to the above-described swift movement of the developer 3 in the developing region Z. As a result, the developer forms a normal magnetic brush in the developing region Z, thereby preventing the appearance of streaks on the resulting image.

In the above embodiment, the permanent magnet member is provided with two peaks in the magnetic flux density distribution of magnetic flux density on the surface of the sleeve 5 in the developing region. The permanent magnet member may also be provided with three or more of peaks in the magnetic flux density distribution. The above plurality of peaks can be obtained not only by making a recess at a developing pole as described above, but also by other means such as changing magnetization patterns. Further, the moving direction of the developer and that of the photosensitive member may be set opposite to each other, without altering the function which is obtained in the case where the two move in the same direction.

Due to the construction and function described above, following effects are achieved.

(1) Since a high moving velocity of the developer can be obtained in the developing region without increasing the rotation velocity of the sleeve, improved development efficiency can be attained easily, thereby resulting in a high-density image. This also means that the developer is not subjected to a large load, so that a stable development can be achieved for a long period of time. In this aspect, the developing method according to the present invention is particularly useful to high- and medium-speed electrophotographic processes which generally require a developer having a high moving velocity in a developing region.

(2) Since a change in a toner concentration scarcely affects the image quality, the toner concentration can be determined within a rather wide range without the necessity of troublesome operations such its concentration-controlling and concentration-maintenance.

(3) Since the developer moves in the developing region fast enough to make up for a developer shortage caused by a foreign matter, undesirable phenomena such as white streaks etc. can be avoided thereby constantly producing a high-quality image.

What is claimed is:

1. A developing apparatus for developing an electrostatic latent image on a surface of a moving image-bearing member, the apparatus comprising:

a developing unit including a fixed permanent magnetic member having a surface, a plurality of magnetic poles on the surface, and a non-magnetic cylindrical sleeve mounted to be rotatable about the permanent magnet member at a position with an outer sleeve surface opposing and spaced from the movable image-bearing member to form a developing region having a development gap of 0.2–0.6 mm, said permanent magnet member having a surface, two magnetic poles of the same polarity disposed with a small interval for producing at least two peaks having the same polarity in a magnetic flux density distribution on the surface of said non-magnetic sleeve, said surface magnetic flux density of each of said two peaks being about 700–1200 G and said image bearing member having an organic photosensitive surface having a surface potential of 400–700 V in an absolute value;

the unit further including a developer magnetically attractable onto the surface of the non-magnetic cylindrical sleeve, the developer comprising magnetic toner comprising a binder resin, magnetic powder and charge-controlling agent and capable of being charged at a particular polarity and a magnetic carrier having a relatively large conductivity represented by an electrical resistivity of $10^5$–$10^{10}$ Ω-cm, the concentration of said magnetic toner in said developer being 20–60% in said developing region; and means for rotating the non-magnetic cylindrical sleeve to convey the developer into the developing region and to form a magnetic brush which is in contact with the surface of the movable image-bearing member in the developing region, at a peripheral velocity not lower than the peripheral velocity of said movable image-bearing member, the ratio of the peripheral velocity of the sleeve to the peripheral velocity of the image-bearing member being between 1 and 4; and wherein the moving velocity of the developer in the developing region is higher than the peripheral velocity of the non-magnetic cylindrical sleeve, and wherein a bias voltage 0.6 to 0.9 times as large as said surface potential, and of the same polarity, is applied to said sleeve.

2. The developing apparatus as in claim 1, wherein the surface magnetic flux density of each of said two peaks is about 1000G and the surface magnetic flux density between said two peaks is about 800G.

3. The developing apparatus as in claim 1, wherein the surface magnetic flux density between said two peaks is non-zero and of the same polarity as said two peaks.

* * * * *